US010210784B2

(12) United States Patent
Zeng et al.

(10) Patent No.: US 10,210,784 B2
(45) Date of Patent: Feb. 19, 2019

(54) DRIVING CIRCUIT AND METHOD OF DRIVING DISPLAY PANEL

(71) Applicant: SHENZHEN CHINA STAR OPTOELECTRONICS TECHNOLOGY CO., LTD., Guangdong (CN)

(72) Inventors: Yuchao Zeng, Guangdong (CN); Taijiun Hwang, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 14/890,829

(22) PCT Filed: Aug. 6, 2015

(86) PCT No.: PCT/CN2015/086242

§ 371 (c)(1),
(2) Date: Nov. 12, 2015

(87) PCT Pub. No.: WO2016/187960

PCT Pub. Date: Dec. 1, 2016

(65) Prior Publication Data

US 2018/0068604 A1 Mar. 8, 2018

(30) Foreign Application Priority Data

May 25, 2015 (CN) ..... 2015 1 0268619

(51) Int. Cl.
*G09G 3/20* (2006.01)
*G09G 3/36* (2006.01)

(52) U.S. Cl.
CPC ..... *G09G 3/20* (2013.01); *G09G 3/3688* (2013.01); *G09G 2310/0297* (2013.01)

(58) Field of Classification Search
CPC . G09G 3/20; G09G 3/3688; G09G 2310/0297
See application file for complete search history.

(56) References Cited

U.S. PATENT DOCUMENTS

2008/0259234 A1 10/2008 Lin et al.
2011/0181804 A1* 7/2011 You ..... G02F 1/13624 349/33
2013/0235091 A1* 9/2013 Tsai ..... G09G 3/003 345/690

FOREIGN PATENT DOCUMENTS

CN 101009083 A 8/2007
CN 101021638 A 8/2007
CN 102693694 A 9/2012

OTHER PUBLICATIONS

Chinese Office Action dated Dec. 28, 2016 in connection with the counterpart Chinese Patent Application No. 201510268619.5.

* cited by examiner

*Primary Examiner* — Abhishek Sarma
(74) *Attorney, Agent, or Firm* — Hauptman Ham, LLP

(57) ABSTRACT

A driving circuit and a method for driving a display panel are proposed. The driving circuit includes: a clock controller; a scan signal driver for generating a first scan signal and a second scan signal; a data signal driver for receiving a source data signal, and generating a first data signal, and generating a second data signal based on the first data signal. A gray level value corresponding to the first data signal is different from a gray level value corresponding to the second data signal. The present invention is able to reduce color shift.

18 Claims, 7 Drawing Sheets

DRIVING CIRCUIT AND METHOD OF DRIVING DISPLAY PANEL

BACKGROUND OF THE INVENTION

1. Field of the Invention

The present invention relates to a driving technology, more particularly, to a driving circuit and a method of driving a display panel.

2. Description of the Related Art

In a conventional display panel, the technical solution for reducing color shift is generally:

The main pixel and the sub-pixel in a pixel unit are simultaneously charged with the same voltage and the sub-pixel is then discharged, so that the main pixel and sub-pixel have different voltages, thus reducing color shift.

In consideration of the above technical solution, each pixel unit requires an additional capacitor for discharging and an additional thin film transistor switch for controlling the capacitor, which in turn increases the manufacturing processes and manufacturing cost of the display panel and reduces the aperture ratio of the display panel because of the excessive complexity of the circuit in the display panel.

It is therefore very important to provide a new technical solution to resolve the above-mentioned technical problems.

SUMMARY OF THE INVENTION

It is an objective of the present invention to provide a driving circuit and a method of driving a display panel to reduce color shift and realize a better display effect.

In order to solve the above-mentioned problems, the technical solution according the present invention is as follows:

A driving circuit is configured to provide a driving signal to a display panel so as to drive the display panel to display an image. The display panel comprises a thin film transistor switch assembly, a scan line assembly, a data line, and a pixel unit. The thin film transistor switch assembly comprises a first thin film transistor switch and a second thin film transistor switch. The scan line assembly comprises a first scan line and a second scan line. The pixel unit comprises a first sub-pixel and a second sub-pixel. The first sub-pixel is connected to the first scan line and the data line in the display panel. The second sub-pixel is connected to the second scan line and the data line in the display panel. The driving circuit comprises a clock controller, a scan signal driver, and a data signal driver. The scan signal driver is configured to generate a first scan signal and a second scan signal. The data signal driver is configured to receive a source data signal, and generate a first data signal based on the source data signal, and generate a second data signal based on the first data signal. The first data signal is configured to be provided to the first sub-pixel, the second data signal is configured to be provided to the second sub-pixel. A gray level value corresponding to the first data signal is different from a gray level value corresponding to the second data signal. The time controller is connected to the scan signal driver and the data signal driver.

Furthermore, the data signal driver comprises a first data signal output module, a second data signal output module, a source data receiving module, and a second data signal generation module. The first data signal output module is configured to output the first data signal to the first sub-pixel. The second data signal output module is configured to output the second data signal to the second sub-pixel. The source data receiving module is configured to receive source data corresponding to the image to be displayed, and to provide the first data signal to the first data signal output module. The second data signal generation module is configured to receive the first data signal from the source data receiving module, and to generate the second data signal based on the first data signal. The source data receiving module is connected to the first data signal output module, the source data receiving module is connected to the second data signal generation module, the second data signal generation module is connected to the second data signal output module.

Furthermore, the second data signal generation module comprises: a lookup table module connected to the source data receiving module and the second data signal output module, the lookup table module being configured to look up a table based on the first data signal to obtain a lookup result, and generate the second data signal based on the lookup result.

Furthermore, the second data signal corresponding to the lookup result has two more bits than the first data signal.

Furthermore, the second data signal generation module further comprises a frame ratio control module connected to the lookup table module and the second data signal output module. The frame ratio control module is configured to control an output frequency of the second data signal to allow the second sub-pixel to display an image different from the first sub-pixel.

Furthermore, the data signal driver further comprises a clock generator configured to generate a first clock signal and a second clock signal, and respectively transmit the first clock signal and the second clock signal to the first data signal output module and the second data signal output module.

According to the present invention, a driving circuit is configured to provide a driving signal to a display panel so as to drive the display panel to display an image. The display panel comprises a pixel unit. The pixel unit comprises a first sub-pixel and a second sub-pixel. The first sub-pixel is connected to the first scan line and the data line in the display panel. The second sub-pixel is connected to the second scan line and the data line in the display panel. The driving circuit comprises a clock controller, a scan signal driver, and a data signal driver. The scan signal driver is configured to generate a first scan signal and a second scan signal. The data signal driver is configured to receive a source data signal, and generate a first data signal based on the source data signal, and generate a second data signal based on the first data signal. The first data signal is configured to be provided to the first sub-pixel, the second data signal is configured to be provided to the second sub-pixel. A gray level value corresponding to the first data signal is different from a gray level value corresponding to the second data signal. The time controller is connected to the scan signal driver and the data signal driver.

Furthermore, the data signal driver comprises a first data signal output module configured to output the first data signal to the first sub-pixel; a second data signal output module configured to output the second data signal to the second sub-pixel; a source data receiving module configured to receive source data corresponding to the image to be displayed, and provide the first data signal to the first data signal output module; and a second data signal generation module configured to receive the first data signal from the source data receiving module, and generate the second data signal based on the first data signal; wherein the source data receiving module is connected to the first data signal output module, the source data receiving module is connected to the second data signal generation module, the second data signal generation module is connected to the second data signal output module.

Furthermore, the second data signal generation module comprises: a lookup table module connected to the source data receiving module and the second data signal output module, the lookup table module being configured to look up a table based on the first data signal to obtain a lookup result, and generate the second data signal based on the lookup result.

Furthermore, the second data signal corresponding to the lookup result has two more bits than the first data signal.

Furthermore, the second data signal generation module further comprises: a frame ratio control module connected to the lookup table module and the second data signal output module, the frame ratio control module being configured to control an output frequency of the second data signal to allow the second sub-pixel to display an image different from the first sub-pixel.

Furthermore, the frame ratio control module is configured to display an image corresponding to the second data signal by utilizing a four-frame picture.

Furthermore, the data signal driver further comprises: a clock generator configured to generate a first clock signal and a second clock signal, and respectively transmit the first clock signal and the second clock signal to the first data signal output module and the second data signal output module.

According to the present invention, a method of driving a display panel by utilizing the above-mentioned driving circuit comprises the steps of: A: generating the first scan signal and the second scan signal by the scan signal driver; and B: receiving the source data signal and generating the first data signal based on the source data signal, and generating the second data signal based on the first data signal by the data signal driver, wherein the first data signal is configured to be provided to the first sub-pixel, the second data signal is configured to be provided to the second sub-pixel, the gray level value corresponding to the first data signal is different from the gray level value corresponding to the second data signal.

Furthermore, step B comprises the following steps: b1: receiving source data corresponding to the image to be displayed, and providing the first data signal to a first data signal output module by a source data receiving module in the data signal driver; b2: outputting the first data signal to the first sub-pixel by the first data signal output module in the data signal driver; b3: receiving the first data signal from the source data receiving module and generating the second data signal based on the first data signal by a second data signal generation module in the data signal driver; and b4: outputting the second data signal to the second sub-pixel by a second data signal output module in the data signal driver.

Furthermore, step b3 comprises: b31: looking up a table based on the first data signal to obtain a lookup result, and generating the second data signal based on the lookup result by a lookup table module in the second data signal generation module.

Furthermore, the second data signal corresponding to the lookup result has two more bits than the first data signal.

Furthermore, step b3 further comprises: b32: controlling an output frequency of the second data signal to allow the second sub-pixel to display an image different from the first sub-pixel by a frame ratio control module in the second data signal generation module.

Furthermore, step b32 comprises: b321: displaying an image corresponding to the second data signal by utilizing a four-frame picture by the frame ratio control module.

Furthermore, step b3 further comprises: b33: generating a first clock signal and a second clock signal, and respectively transmitting the first clock signal and the second clock signal to the first data signal output module and the second data signal output module by a clock generator in the data signal driver.

As compared with the prior art, the present invention is able to reduce color shift. Not only is the color shift steadily reduced, but the display quality of the display panel is also improved.

These and other features, aspects and advantages of the present disclosure will become understood with reference to the following description, appended claims and accompanying figures.

DESCRIPTION OF THE EMBODIMENTS

The terminology used herein is for the purpose of describing particular embodiments only and is not intended to be limiting of the invention. As used herein, the singular forms "a", "an" and "the" are intended to include the plural forms as well, unless the context clearly indicates otherwise.

Figure 1:
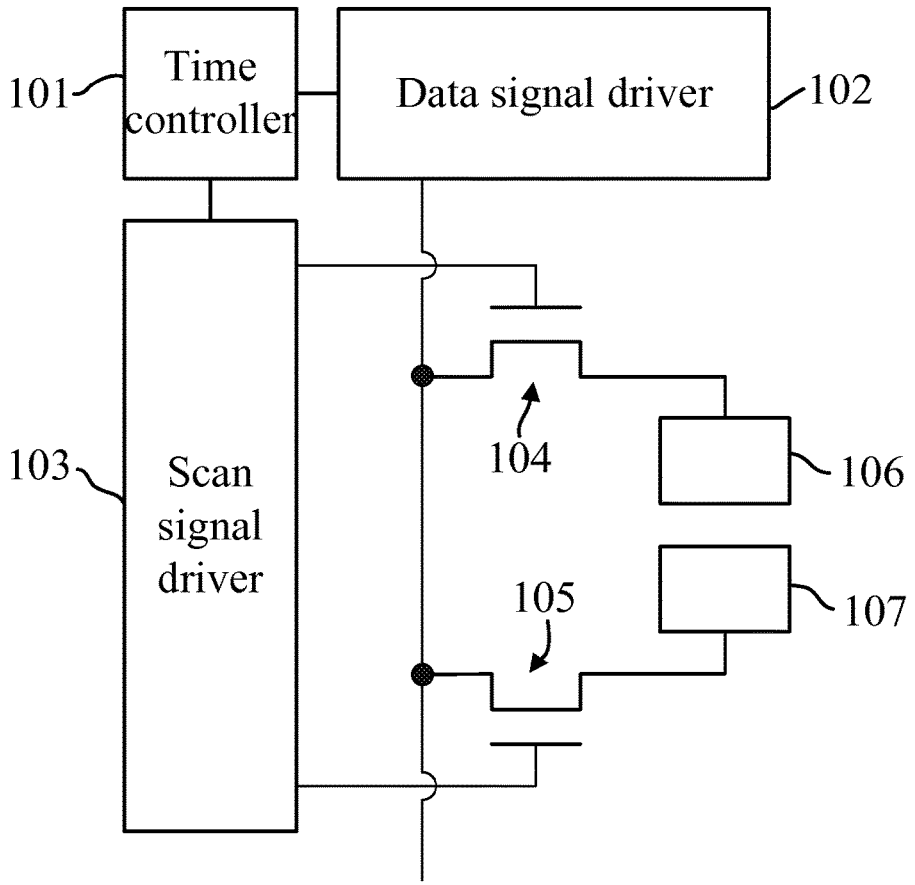
FIG. 1 is a schematic diagram of connection relations between a driving circuit and a pixel unit in a display panel according to the present invention.
Figure 2:
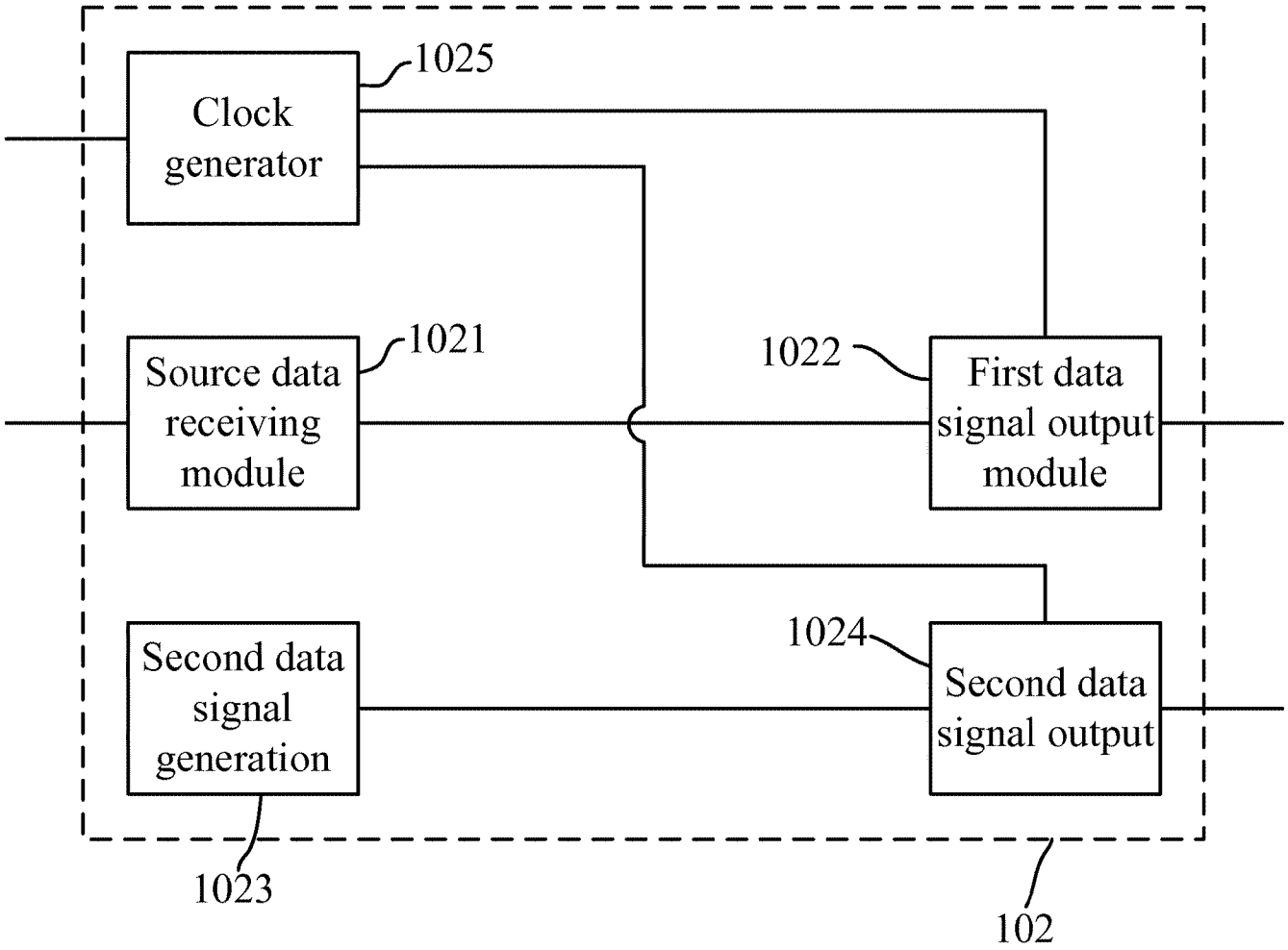
FIG. 2 is a block diagram of a data signal driver in FIG. 1 according to a first embodiment of the present invention.

Refer to FIG. 1 and FIG. 2, FIG. 1 is a schematic diagram of connection relations between a driving circuit and a pixel unit in a display panel according to the present invention. FIG. 2 is a block diagram of a data signal driver 102 in FIG. 1 according to a first embodiment of the present invention.

A driving circuit according to the present embodiment is connected to a display panel. The driving circuit is configured to provide a driving signal to the display panel to drive the display panel so as to display images.

The display panel may be a thin film transistor liquid crystal display (TFT-LCD) panel, an organic light emitting diode (OLED) display panel, etc.

The display panel comprises a thin film transistor (TFT) switch assembly, a scan line assembly, a data line, and a pixel unit. The TFT switch assembly comprises a first TFT switch 104 and a second TFT switch 105. The first TFT switch 104 is configured to receive a first scan signal from a first scan line and control opening or closing of a first current path between the data line and a first sub-pixel 106 based on the first scan signal. The second TFT switch 105 is configured to receive a second scan signal from a second scan line and control the opening or closing of a second current path between the data line and a second sub-pixel 107based on the second scan signal. The scan line assembly comprises the first san line and the second scan line. The pixel unit comprises the first sub-pixel 106 and the second sub-pixel 107. The first sub-pixel 106 is connected to the first scan line and the data line through the first TFT switch 104. The second sub-pixel 107 is connected to the second scan line and the data line through the second TFT switch 105.

The driving circuit comprises a time controller 101, a scan signal driver 103, and the data signal driver 102. The time controller 101 is connected to the scan signal driver 103 and the data signal driver 102. The scan signal driver 103 is configured to generate the first scan signal and the second scan signal. The data signal driver 102 is configured to receive a source data signal, and generate a first data signal based on the source data signal, and generate a second data signal based on the first data signal. The first data signal is configured to be provided to the first sub-pixel 106. The second data signal is configured to be provided to the second sub-pixel 107. A gray level value corresponding to the first data signal is different from a gray level value corresponding to the second data signal.

In the present embodiment, the data signal driver 102 comprises a first data signal output module 1022, a second data signal output module 1024, a source data receiving module 1021, and a second data signal generation module 1023. The source data receiving module 1021 is connected to the first data signal output module 1022. The source data receiving module 1021 is connected to the second data signal generation module 1023. The second data signal generation module 1023 is connected to the second data signal output module 1024. The first data signal output module 1022 is configured to output the first data signal to the first sub-pixel 106. The second data signal output module 1024 is configured to output the second data signal to the second sub-pixel 107. The source data receiving module 1021 is configured to receive source data corresponding to the image to be displayed, and provide the first data signal to the first data signal output module 1022. The second data signal generation module 1023 is configured to receive the first data signal from the source data receiving module 1021 and generate the second data signal based on the first data signal.

Through the above technical solution, the color shift is reduced. Not only is the color shift steadily reduced, but the display quality of the display panel is also improved. In addition, there is no necessity to dispose an extra pixel circuit (such as a capacitor and a TFT switch).

A second embodiment of the present invention driving circuit is similar to that of the first embodiment. The difference lies in:

In the present embodiment, the second data signal generation module 1023 comprises a lookup table module 10231. The lookup table module 10231 is connected to the source data receiving module 1021 and the second data signal output module 1024. The lookup table module 10231 is configured to look up a table based on the first data signal to obtain a lookup result, and generate the second data signal based on the lookup result. The second data signal (a lookup gray level) corresponding to the lookup result has two more bits than the first data signal.

Figure 3:
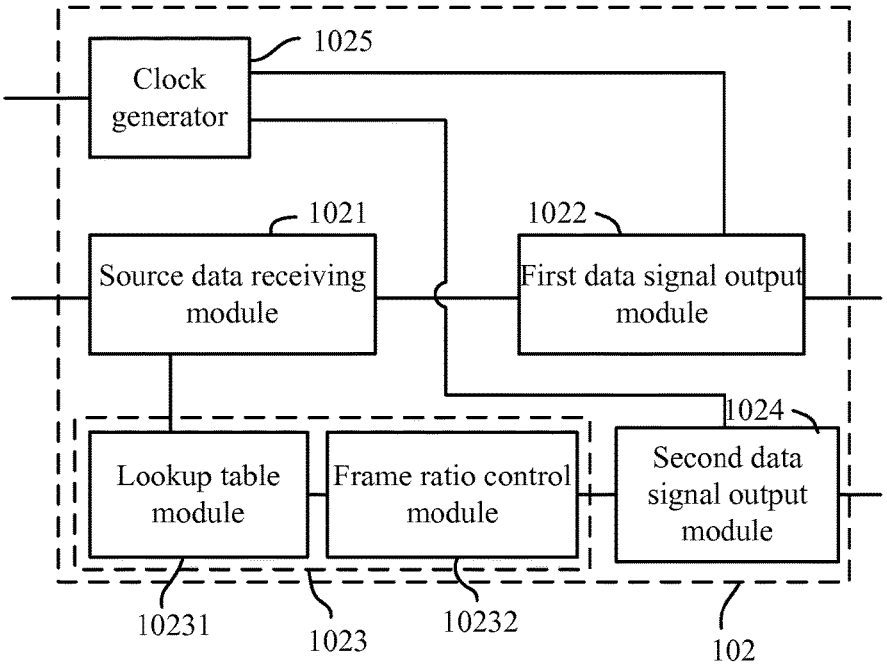
FIG. 3 is a block diagram of the data signal driver in FIG. 1 according to a third embodiment of the present invention.

Refer to FIG. 3, FIG. 3 is a block diagram of the data signal driver 102 in FIG. 1 according to a third embodiment of the present invention. The present embodiment is similar to the second embodiment. The difference lies in:

In the present embodiment, the second data signal generation module 1023 further comprises a frame ratio control module 10232. The frame ratio control module 10232 is connected to the lookup table module 10231 and the second data signal output module 1024. The frame ratio control module 10232 is configured to control an output frequency of the second data signal to allow the second sub-pixel 107 to display an image different from the first sub-pixel 106.

Figure 8:
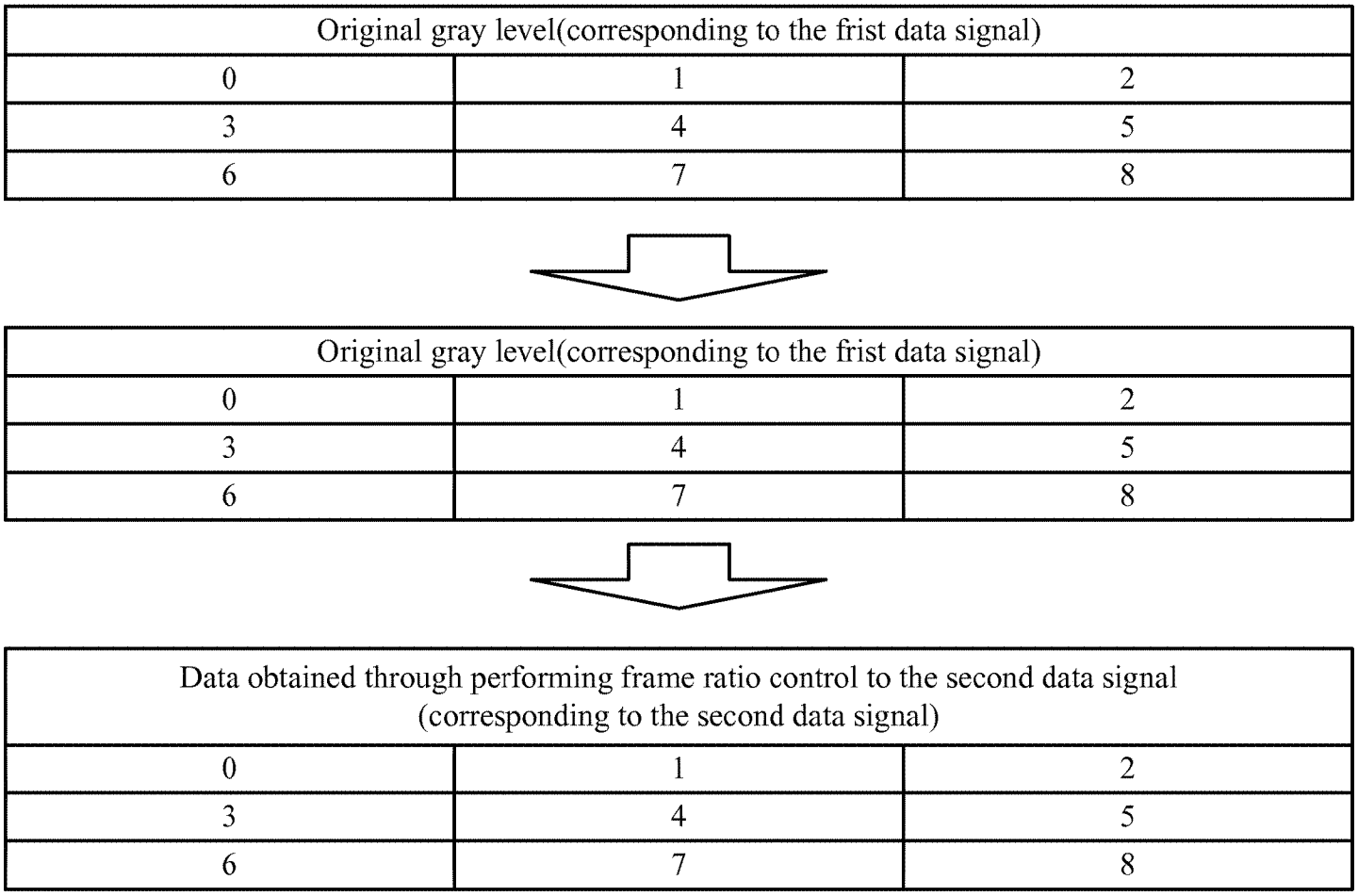
FIG. 8 is a schematic diagram showing that a second data signal generation module generates a second data signal based on a first data signal.

As shown in FIG. 8, if the grey level value corresponding to the first data signal is eight, that is, an original grey level value is eight, the first data signal output module 1022 outputs the grey level value eight to the first sub-pixel 106 at a frequency two times a pixel frequency. The lookup table module 10231obtains a corresponding lookup gray level value of thirty through looking up the table. The second data signal output module 1024 sequentially outputs the gray level values eight, eight, seven, seven at a frequency eight times the pixel frequency.

The frame ratio control module 10232 is configured to display an image corresponding to the second data signal by utilizing a four-frame picture.

A fourth embodiment of the present invention driving circuit is similar to any of those of the first embodiment to the third embodiment. The difference lies in:

In the present embodiment, the data signal driver 102 further comprises a clock generator 1025. The clock generator 1025 is configured to generate a first clock signal and a second clock signal, and respectively transmit the first clock signal and the second clock signal to the first data signal output module 1022 and the second data signal output module 1024.

Figure 4:
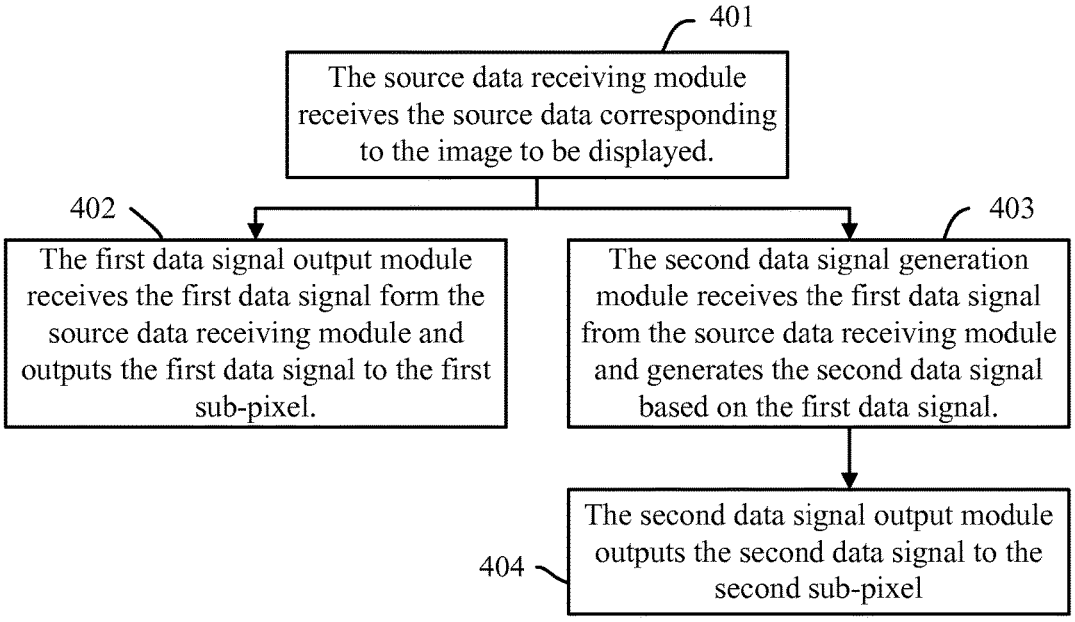
FIG. 4 is a flowchart of steps for generating data signals by a data signal driver in a method of driving a display panel by a driving circuit according to a first embodiment of the present invention.

Refer to FIG. 4, FIG. 4 is a flowchart of steps for generating data signals by the data signal driver 102 in a method of driving a display panel by a driving circuit according to a first embodiment of the present invention.

According to the present embodiment, the method comprises the following steps:

A(step 402): the scan signal driver 103 generates the first scan signal and the second scan signal.

B:the data signal driver 102 receives the source data signal and generates the first data signal based on the source data signal, and generates the second data signal based on the first data signal. The first data signal is configured to be provided to the first sub-pixel 106. The second data signal is configured to be provided to the second sub-pixel 107. The gray level value corresponding to the first data signal is different from the gray level value corresponding to the second data signal.

Step B comprises the following steps:

b1(step 401): the source data receiving module 1021 in the data signal driver 102 receives the source data corresponding to the image to be displayed, and provides the first data signal to the first data signal output module 1022.

b2(step 402):the first data signal output module 1022 in the data signal driver 102 outputs the first data signal to the first sub-pixel 106.

b3(step 403):the second data signal generation module 1023 in the data signal generator 102 receives the first data signal from the source data receiving module 1021 and generates the second data signal based on the first data signal.

b4(step 404):the second data signal output module 1024 in the data signal driver 102 outputs the second data signal to the second sub-pixel 107.

Through the above technical solution, the color shift is reduced. Not only is the color shift steadily reduced, but the display quality of the display panel is also improved. In addition, there is no necessity to dispose an extra pixel circuit (such as a capacitor and a TFT switch).

Figure 5:
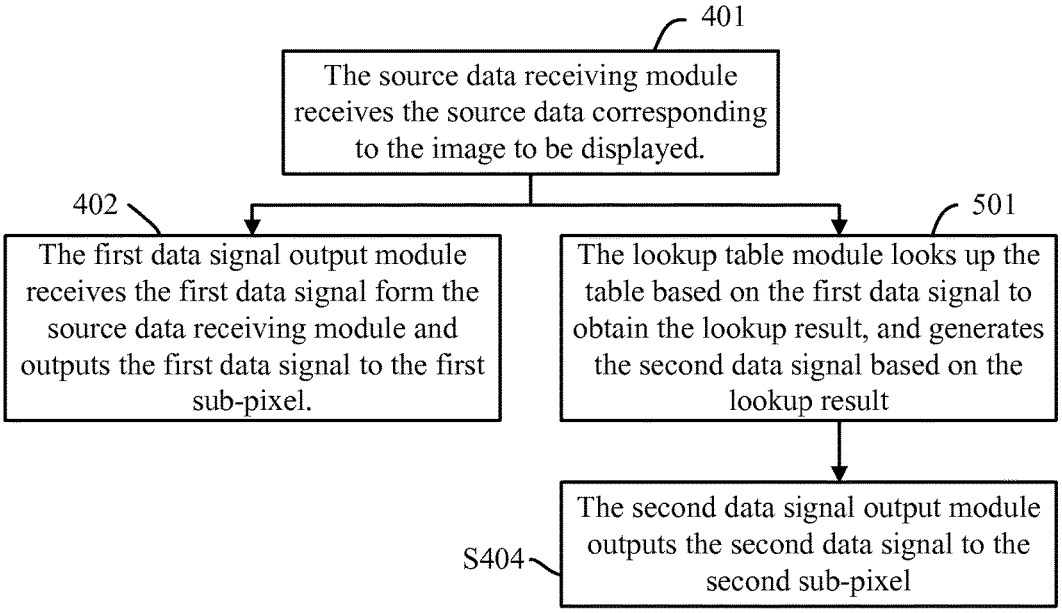
FIG. 5 is a flowchart of steps for generating data signals by a data signal driver in a method of driving a display panel by a driving circuit according to a second embodiment of the present invention.

Refer to FIG. 5, FIG. 5 is a flowchart of steps for generating data signals by the data signal driver 102 in a method of driving a display panel by a driving circuit according to a second embodiment of the present invention. The present embodiment is similar to the first embodiment. The difference lies in:

In the present embodiment, step b3(step 403) comprises the following steps:

b31 (step 501):the lookup table module 10231 in the second data signal generation module 1023 looks up the table based on the first data signal to obtain the lookup result, and generates the second data signal based on the lookup result. The second data signal (the lookup gray level) corresponding to the lookup result has two more bits than the first data signal.

Figure 6:
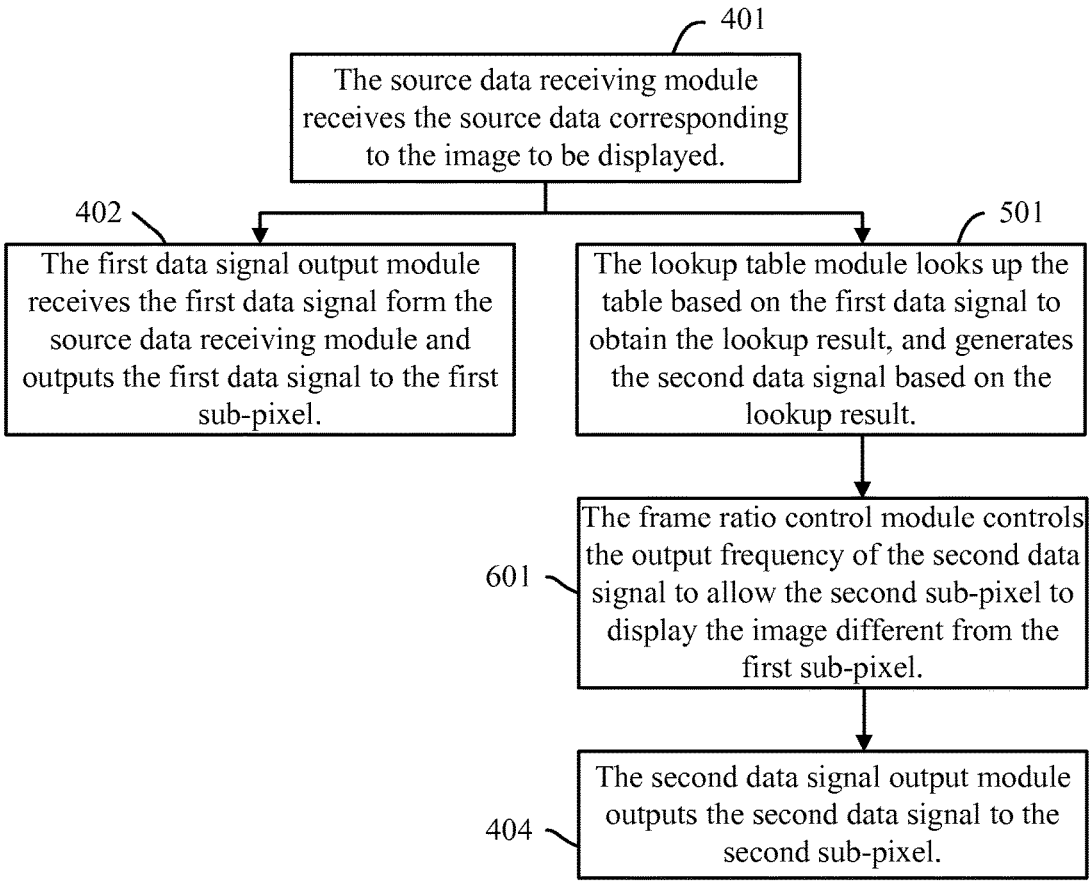
FIG. 6 is a flowchart of steps for generating data signals by a data signal driver in a method of driving a display panel by a driving circuit according to a third embodiment of the present invention.

Refer to FIG. 6, FIG. 6 is a flowchart of steps for generating data signals by the data signal driver 102 in a method of driving a display panel by a driving circuit according to a third embodiment of the present invention. The present embodiment is similar to the second embodiment. The difference lies in:

In the present embodiment, step b3 (step 403) further comprises the following steps:

b32 (step 601):the frame ratio control module 10232 in the second data signal generation module 1023 controls the output frequency of the second data signal to allow the second sub-pixel 107 to display the image different from the first sub-pixel 106.

As shown in FIG. 8, if the grey level value corresponding to the first data signal is eight, that is, the original grey level value is eight, the first data signal output module 1022 outputs the grey level value eight to the first sub-pixel 106 at the frequency two times the pixel frequency. The lookup table module 10231 obtains the corresponding lookup gray level value of thirty through looking up the table. The second data signal output module 1024 sequentially outputs the gray level values eight, eight, seven, seven at the frequency eight times the pixel frequency.

In step b32: the frame ratio control module 10232 displays the image corresponding to the second data signal by utilizing the four-frame picture.

Figure 7:
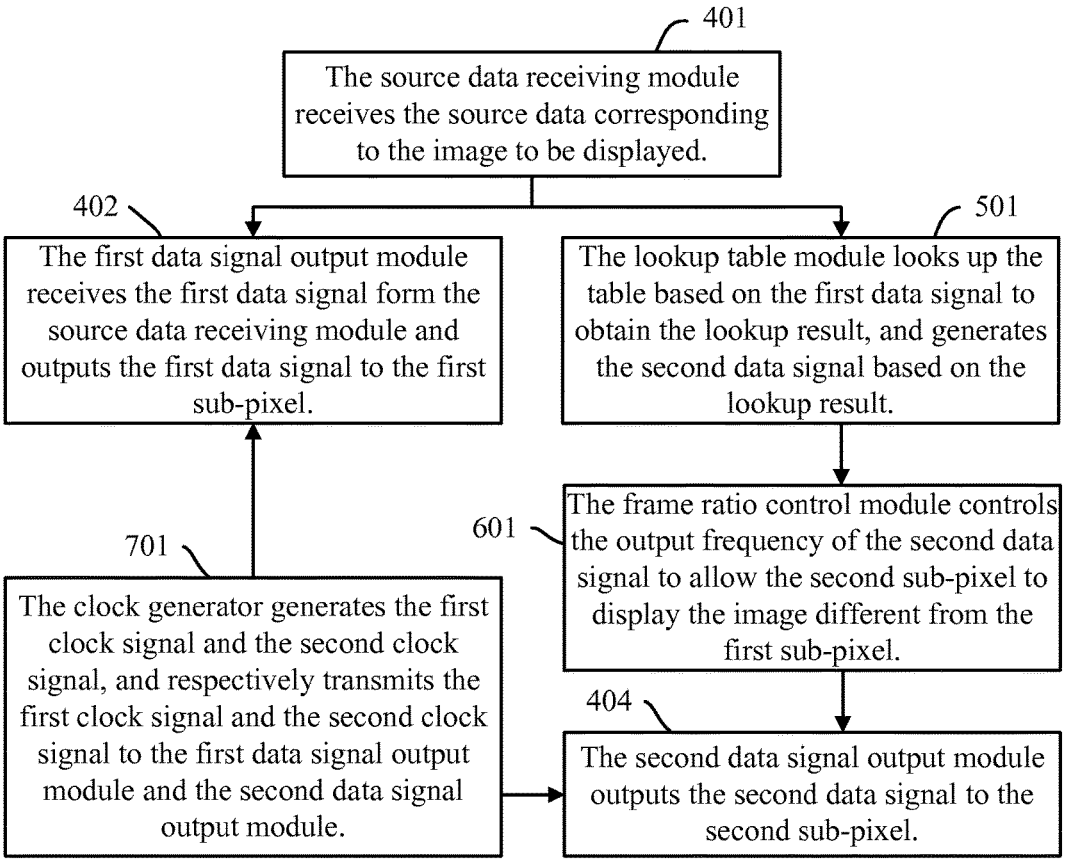
FIG. 7 is a flowchart of steps for generating data signals by a data signal driver in a method of driving a display panel by a driving circuit according to a fourth embodiment of the present invention.

Refer to FIG. 7, FIG. 7 is a flowchart of steps for generating data signals by the data signal driver 102 in a method of driving a display panel by a driving circuit according to a fourth embodiment of the present invention. The present embodiment is similar to any of the first embodiment to the third embodiment. The difference lies in:

Step b3 (step 403) further comprises the following steps:

b33 (step 701): the clock generator 1025 in the data signal driver 102 generates the first clock signal and the second clock signal, and respectively transmits the first clock signal and the second clock signal to the first data signal output module 1022 and the second data signal output module 1024.

Moreover, despite one or more implementations relative to the present disclosure being illustrated and described, equivalent alterations and modifications will occur to others skilled in the art upon reading and understanding this specification and the annexed drawings. The present disclosure comprises such modifications and variations, and is to be limited only by the terms of the appended claims. In particular, regarding the various functions performed by the above described components, the terms used to describe such components (i.e. elements, resources, etc.) are intended to correspond (unless otherwise indicated) to any component, which performs the specified function of the described component (i.e., that is, functionally equivalent), even though not structurally equivalent to the disclosed structure which performs the function in the illustrated implementations of the disclosure. In addition, although a particular feature of the disclosure may have been disclosed with respect to only one of several implementations, such a feature may be combined with one or more other features of the other implementations as may be desired and advantageous for any given or particular application. Also, to the extent that the terms "including", "includes", "having", "has", "with", or variants thereof are used in the detailed description or in the claims, such terms are intended to be inclusive in a manner similar to the term "comprising".

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A driving circuit configured to provide a driving signal to a display panel so as to drive the display panel to display an image;

wherein the display panel comprises an thin film transistor switch assembly, a scan line assembly, a data line, and a pixel unit;

the thin film transistor switch assembly comprising a first thin film transistor switch and a second thin film transistor switch;

the scan line assembly comprising a first scan line and a second scan line;

the pixel unit comprising a first sub-pixel and a second sub-pixel, wherein the first sub-pixel is connected to the first scan line and the data line in the display panel, the second sub-pixel is connected to the second scan line and the data line in the display panel;

wherein the driving circuit comprises:

a time controller;

a scan signal driver configured to generate a first scan signal and a second scan signal; and a data signal driver configured to receive a source data signal, and generate a first data signal based on the source data signal, and generate a second data signal based on the first data signal, wherein the first data signal is configured to be provided to the first sub-pixel, the second data signal is configured to be provided to the second sub-pixel, a gray level value corresponding to the first data signal is different from a gray level value corresponding to the second data signal;

wherein the time controller is connected to the scan signal driver and the data signal driver, wherein the data signal driver comprises:

a first data signal output module configured to output the first data signal to the first sub-pixel;

a second data signal output module configured to output the second data signal to the second sub-pixel;

a source data receiving module configured to receive source data corresponding to the image to be displayed, and provide the first data signal to the first data signal output module; and a second data signal generation module configured to receive the first data signal from the source data receiving module, and generate the second data signal based on the first data signal, wherein the source data receiving module is connected to the first data signal output module, the source data receiving module is connected to the second data signal generation module, the second data signal generation module is connected to the second data signal output module.

2. The driving circuit as claimed in claim 1, wherein the second data signal generation module comprises:

a lookup table module connected to the source data receiving module and the second data signal output module, the lookup table module being configured to look up a table based on the first data signal to obtain a lookup result, and generate the second data signal based on the lookup result.

3. The driving circuit as claimed in claim 2, wherein the second data signal corresponding to the lookup result has two more bits than the first data signal.

4. The driving circuit as claimed in claim 2, wherein the second data signal generation module further comprises:

a frame ratio control module connected to the lookup table module and the second data signal output module, the frame ratio control module being configured to control an output frequency of the second data signal to allow the second sub-pixel to display an image different from the first sub-pixel.

5. The driving circuit as claimed in claim 1, wherein the data signal driver further comprises:

a clock generator configured to generate a first clock signal and a second clock signal, and respectively transmit the first clock signal and the second clock signal to the first data signal output module and the second data signal output module.

6. A driving circuit configured to provide a driving signal to a display panel so as to drive the display panel to display an image;

wherein the display panel comprises a pixel unit comprising a first sub-pixel and a second sub-pixel, wherein the first sub-pixel is connected to a first scan line and a data line in the display panel, the second sub-pixel is connected to a second scan line and the data line in the display panel;

wherein the driving circuit comprises:

a time controller;

a scan signal driver configured to generate a first scan signal and a second scan signal; and a data signal driver configured to receive a source data signal, and generate a first data signal based on the source data signal, and generate a second data signal based on the first data signal, wherein the first data signal is configured to be provided to the first sub-pixel, the second data signal is configured to be provided to the second sub-pixel, a gray level value corresponding to the first data signal is different from a gray level value corresponding to the second data signal, wherein the data signal driver comprises:

a first data signal output module configured to output the first data signal to the first sub-pixel;

a second data signal output module configured to output the second data signal to the second sub-pixel;

a source data receiving module configured to receive source data corresponding to the image to be displayed, and provide the first data signal to the first data signal output module; and a second data signal generation module configured to receive the first data signal from the source data receiving module, and generate the second data signal based on the first data signal;

wherein the source data receiving module is connected to the first data signal output module, the source data receiving module is connected to the second data signal generation module, the second data signal generation module is connected to the second data signal output module.

7. The driving circuit as claimed in claim 6, wherein the second data signal generation module comprises:

a lookup table module connected to the source data receiving module and the second data signal output module, the lookup table module being configured to look up a table based on the first data signal to obtain a lookup result, and generate the second data signal based on the lookup result.

8. The driving circuit as claimed in claim 7, wherein the second data signal corresponding to the lookup result has two more bits than the first data signal.

9. The driving circuit as claimed in claim 7, wherein the second data signal generation module further comprises:

a frame ratio control module connected to the lookup table module and the second data signal output module, the frame ratio control module being configured to control an output frequency of the second data signal to allow the second sub-pixel to display an image different from the first sub-pixel.

10. The driving circuit as claimed in claim 9, wherein the frame ratio control module is configured to display an image corresponding to the second data signal by utilizing a four-frame picture.

11. The driving circuit as claimed in claim 6, wherein the data signal driver further comprises:

a clock generator configured to generate a first clock signal and a second clock signal, and respectively transmit the first clock signal and the second clock signal to the first data signal output module and the second data signal output module.

12. A method of driving a display panel by utilizing the driving circuit as claimed in claim 6, comprising:

A: generating the first scan signal and the second scan signal by the scan signal driver; and B: receiving the source data signal and generating the first data signal based on the source data signal, and generating the second data signal based on the first data signal by the data signal driver, wherein the first data signal is configured to be provided to the first sub-pixel, the second data signal is configured to be provided to the second sub-pixel, the gray level value corresponding to the first data signal is different from the gray level value corresponding to the second data signal.

13. The method as claimed in claim 12, wherein step B comprises the following steps:

b1: receiving source data corresponding to the image to be displayed, and providing the first data signal to a first data signal output module by a source data receiving module in the data signal driver;

b2: outputting the first data signal to the first sub-pixel by the first data signal output module in the data signal driver;

b3: receiving the first data signal from the source data receiving module and generating the second data signal based on the first data signal by a second data signal generation module in the data signal driver; and b4: outputting the second data signal to the second sub-pixel by a second data signal output module in the data signal driver.

14. The method as claimed in claim 13, wherein step b3 comprises:

b31: looking up a table based on the first data signal to obtain a lookup result, and generating the second data signal based on the lookup result by a lookup table module in the second data signal generation module.

15. The method as claimed in claim 14, wherein the second data signal corresponding to the lookup result has two more bits than the first data signal.

16. The method as claimed in claim 14, wherein step b3 further comprises:

b32: controlling an output frequency of the second data signal to allow the second sub-pixel to display an image different from the first sub-pixel by a frame ratio control module in the second data signal generation module.

17. The method as claimed in claim 10, wherein step b32 comprises:

b321: displaying an image corresponding to the second data signal by utilizing a four-frame picture by the frame ratio control module.

18. The method as claimed in claim 7, wherein step b3 further comprises:

b33: generating a first clock signal and a second clock signal, and respectively transmitting the first clock signal and the second clock signal to the first data signal output module and the second data signal output module by a clock generator in the data signal driver.

* * * * *